US006932647B2

(12) United States Patent
Murayama

(10) Patent No.: US 6,932,647 B2
(45) Date of Patent: Aug. 23, 2005

(54) CONNECTOR ENHANCED IN ELECTROMAGNETIC SHIELDING FUNCTION

(75) Inventor: Ryusuke Murayama, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 10/846,639

(22) Filed: May 17, 2004

(65) Prior Publication Data

US 2004/0235348 A1 Nov. 25, 2004

(30) Foreign Application Priority Data

May 19, 2003 (JP) ..... 2003-140864

(51) Int. Cl.[7] ..... H01R 13/648
(52) U.S. Cl. ..... 439/607; 439/571
(58) Field of Search ..... 439/607–610, 439/570, 571

(56) References Cited

U.S. PATENT DOCUMENTS 5,643,008 A 7/1997 Tan et al.
5,791,939 A * 8/1998 Tanigawa ..... 439/610
5,865,645 A 2/1999 Embo et al.
6,077,115 A 6/2000 Yang et al.
6,257,916 B1 7/2001 Kuo
6,296,534 B1 * 10/2001 Yi ..... 439/876
6,398,587 B1 * 6/2002 Chen et al. ..... 439/607
6,416,359 B1 * 7/2002 Zhang et al. ..... 439/607
6,454,580 B1 9/2002 Hwang
6,503,102 B1 * 1/2003 Zhang et al. ..... 439/607
6,554,642 B1 * 4/2003 Xiang et al. ..... 439/567
6,554,648 B2 * 4/2003 Shi et al. ..... 439/607
6,582,255 B2 * 6/2003 Simmons et al. ..... 439/701
6,599,151 B2 * 7/2003 Chiran et al. ..... 439/610
6,669,514 B2 * 12/2003 Wiebking et al. ..... 439/701

FOREIGN PATENT DOCUMENTS

EP 0430105 6/1991
EP 0954067 11/1999
JP 7249886 9/1995

* cited by examiner

*Primary Examiner*—Gary Paumen
(74) *Attorney, Agent, or Firm*—Baker Botts L.L.P.

(57) ABSTRACT

In a connector to be mounted on a circuit board, a conductive contact has a contacting portion and a terminal portion and held by an insulator. A conductive shell surrounds the contacting portion of the contact. A conductive shielding cover is held by the insulator and surrounds the terminal portion of the contact. The shielding cover is electrically connected to the shell and the circuit board.

10 Claims, 10 Drawing Sheets

CONNECTOR ENHANCED IN ELECTROMAGNETIC SHIELDING FUNCTION

This application claims priority to prior Japanese patent application JP 2003-140864, the disclosure of which is incorporated herein by reference.

BACKGROUND OF THE INVENTION

This invention relates to a connector and, in particular, to a connector having an electromagnetic shielding function.

In recent years, an electronic apparatus such as a computer, a server, and an exchange is remarkably wide spread. Since the electronic apparatus of the type transmits a high-speed electronic signal, a connector used as an I/O port of the apparatus is desired to have an electromagnetic interference protection.

For example, Japanese Patent Application Publication (JP-A) No. H07-249886 discloses a shielding case for electromagnetically shielding various electronic components mounted on a circuit board. The shielding case covers the electronic components and is connected to the circuit board. As a consequence, the electromagnetic components are protected from electromagnetic interference. However, because the electronic components are entirely covered with the shielding case, the shielding case inevitably becomes large in outer dimension. This prevents reduction in size of the electronic apparatus.

Unlike ordinary electronic components, the connector can not entirely be covered with the shielding case. If the connector is entirely covered with the shielding case, the connector can not achieve electrical and mechanical connection with a mating object to be connected. Under the circumstances, it is desired for the connector to be enhanced in electromagnetic shielding function without being entirely covered with the shielding case.

SUMMARY OF THE INVENTION

It is therefore an object of the present invention to provide a small-sized connector enhanced in electromagnetic shielding function without being entirely covered with a shielding case.

Other objects of the present invention will become clear as the description proceeds.

According to an aspect of the present invention, there is provided a connector to be mounted on a circuit board, the connector comprising a conductive contact having a contacting portion and a terminal portion, an insulator holding the contact, a conductive shell surrounding the contacting portion of the contact; and a conductive shielding cover held by the insulator and surrounding the terminal portion of the contact, the shielding cover being electrically connected to the shell and the circuit board.

DESCRIPTION OF PREFERRED EMBODIMENTS

Figure 1A:
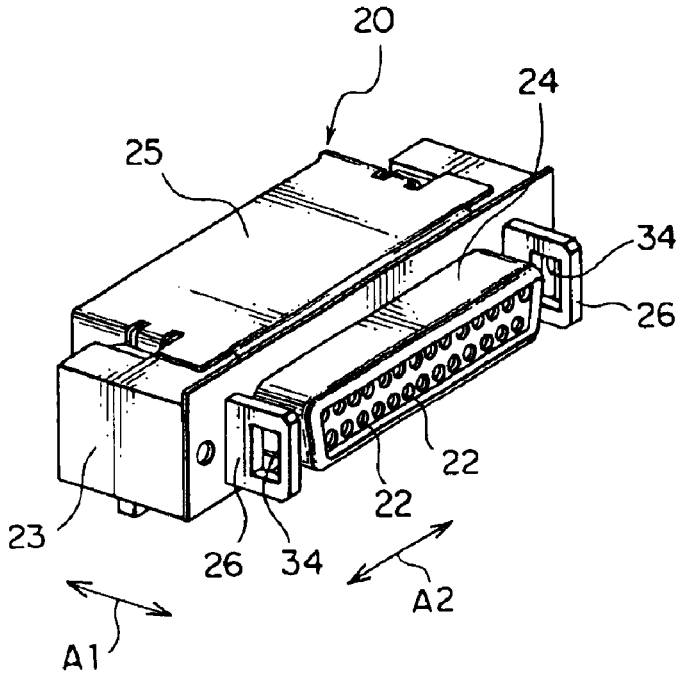
FIG. 1A is a perspective view of a connector according to a first embodiment of the present invention.
Figure 1B:
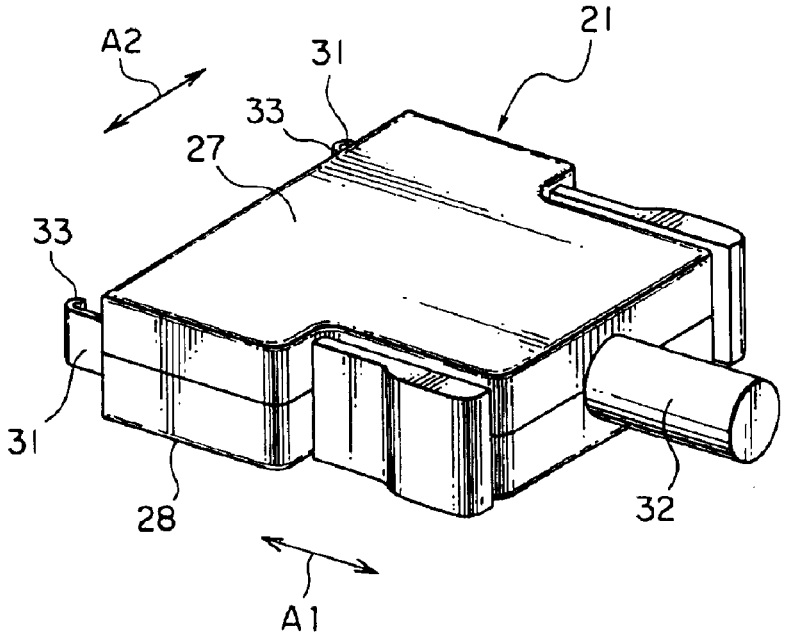
FIG. 1B is a perspective view of another connector as a mating object to be connected to the connector illustrated in FIG. 1A.

Referring to FIGS. 1A and 1B, a connector 20 according to a first embodiment of the present invention will be described together with another connector 21 as a mating object to be connected to the connector 20. Herein, the connector 20 is a receptacle connector while the connector 21 is a plug connector.

The receptacle connector 20 comprises a plurality of conductive receptacle contacts 22, an insulator 23 holding the receptacle contacts 22, a conductive shell or shell plate 24 fixed to a front portion of the insulator 23, a conductive shielding cover 25 held at a rear portion of the insulator 23, and a pair of fixed locking members 26 for obtaining mechanical engagement with the plug connector 21 in a first direction A1. The fixed locking members 26 are spaced from each other in a second direction A2 perpendicular to the first direction A1. Each of the shell plate 24 and the shielding cover 25 is formed by a metal plate.

On the other hand, the plug connector 21 comprises two conductive shells 27 and 28, an insulator (not shown) surrounded by the shells 27 and 28, and a plurality of conductive plug contacts (not shown) held by the insulator. The plug connector 21 is provided with a pair of movable locking members 31 formed at a front portion thereof in one-to-one correspondence to the fixed locking members 26 of the receptacle connector 20. The plug connector 21 has a rear portion from which a coaxial cable 32 connected to the plug contacts is led out.

When the plug connector 21 is butted to the receptacle connector 20 in the first direction A1, the plug and the receptacle connectors 21 and 20 are fitted to each other. As a consequence, the plug contacts are connected to the receptacle contacts 22, respectively. Further, hook portions 33 of the movable locking members 31 are engaged with engaging holes 34 of the fixed locking members 26 in the first direction A1, with the movement in the second direction A2. As a consequence, the plug connector 21 and the receptacle connector 20 are locked in a connected state.

Figure 2:
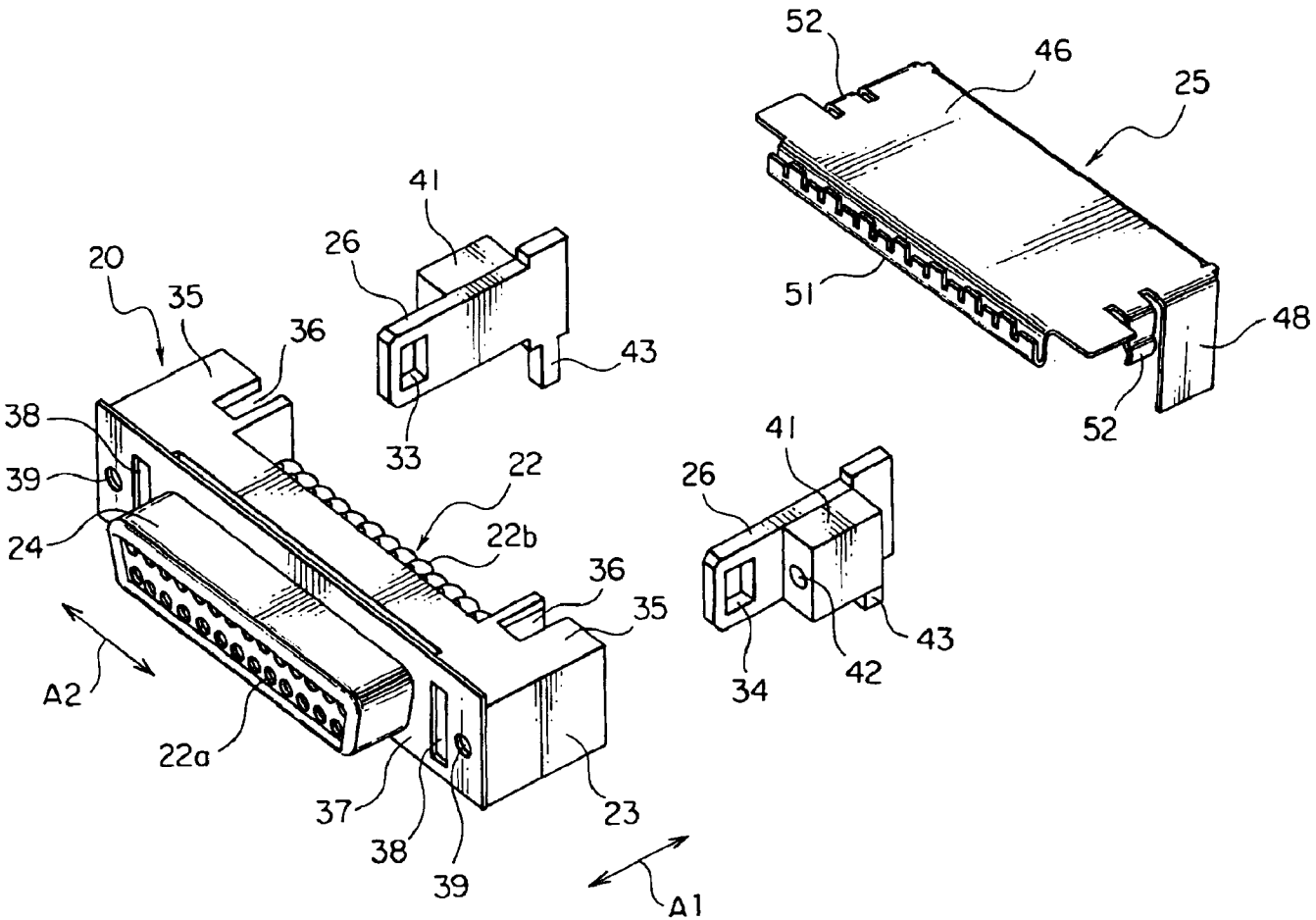
FIG. 2 is an exploded perspective view of the connector illustrated in FIG. 1A.

Also referring to FIG. 2 showing an exploded state, further description will be made of the structure of the receptacle connector 20.

Each of the receptacle contacts 22 has a contacting portion 22*a* disposed at a portion protruding on the front portion of the insulator 23, a terminal portion 22*b* protruding from a rear surface of the insulator 23, and a holding portion (not shown) extending between the contacting portion 22*a* and the terminal portion 22*b* and held by the insulator 23. The contacting portions 22*a* are arranged in two rows extending in the second direction A2. Each of the terminal portions 22*b* has a shape which will later become clear.

The insulator 23 has a pair of protruding portions 35 formed in the vicinity of opposite ends in the second direction A2 and protruding rearward. The terminal portions 22*b* are disposed between the protruding portions 35. Each of the protruding portions 35 is provided with a recessed portion 36. The recessed portions 36 communicate with a pair of slots 38 formed in a flange 37 of the shell plate 24, respectively. The shell plate 24 is provided with a pair of through holes 39 adjacent to the slots 38, respectively.

Each of the fixed locking members 26 has such a size that the locking member 26 can be inserted from the recessed portion 36 into the slot 38. Each of the fixed locking members 26 is provided with a mounting member 41 integrally formed. The mounting member 41 has a front surface provided with a screw hole 42 formed at a position corresponding to the through hole 39 of the shell plate 24. The mounting member 41 has a leg portion 43 protruding downward.

The screw holes 42 of the mounting members 41 are positioned at the through holes 39 of the shell plate 24, respectively. By the use of screw members (not shown), the mounting members 41 are fixed to the shell plate 24. Thus, the mounting members 41, the fixed locking members 26, and the shell plate 24 are securely fixed to the insulator 23.

Figure 3A:
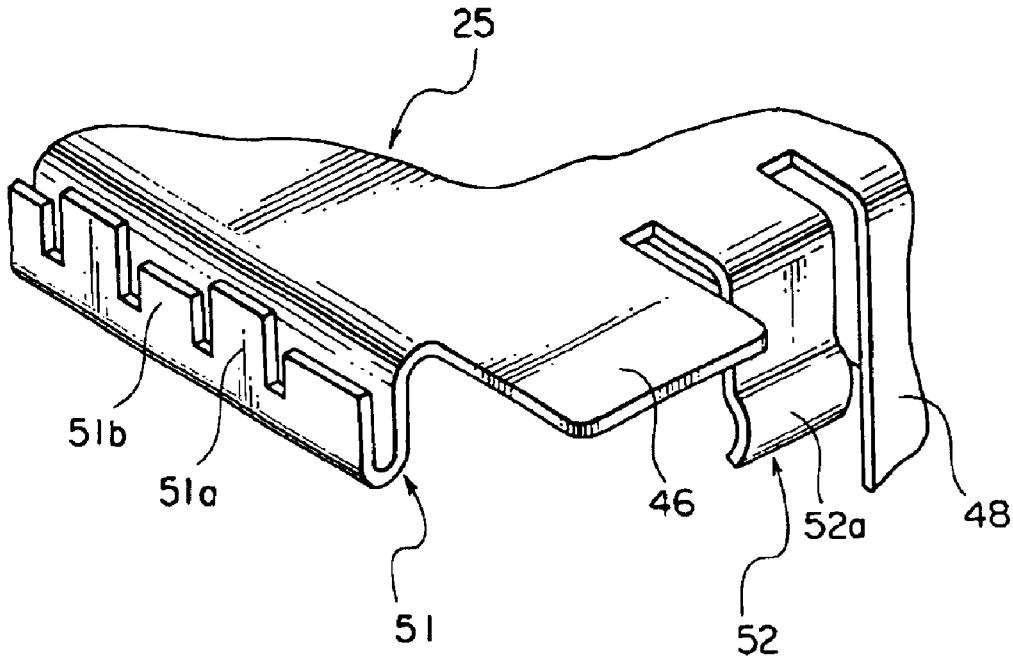
FIG. 3A is an enlarged perspective view of a characteristic part of a shielding cover illustrated in FIG. 2.
Figure 3B:
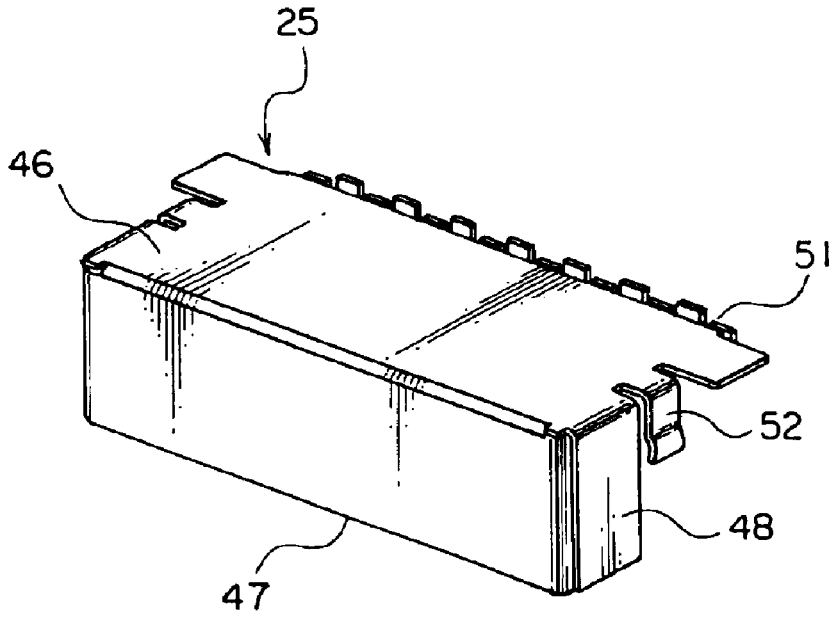
FIG. 3B is a perspective view of the shielding cover illustrated in FIG. 2 as seen from a rear side.

As shown in FIGS. 3A and 3B also, the shielding cover 25 has a main plate portion 46, a rear plate portion 47 perpendicularly folded or bent from a rear end of the main plate portion 46, and a pair of side plate portions 48 perpendicularly folded or bent from opposite side edges of the main plate portion 46. The main plate portion 46 is disposed on an upper surface of the insulator 23 and extends rearward to cover an upper part of a region between the protruding portions 35. The rear plate portion 47 and the side plate portions 48 extend to surround a rear part of the region between the protruding portions 35. Thus, the main plate portion 46, the rear plate portion 47, and the side plate portions 48 defines a space in cooperation with the insulator 23. In the space, the terminal portions 22*b* of the contacts 22 are disposed.

The shielding cover 25 is further provided with a first spring portion 51 formed at a front end of the main plate portion 46 and engaged with the insulator 23 in the first direction A1, and a pair of second spring portions 52 formed at opposite side edges of the main plate portion 46 and engaged with the insulator 23 in the second direction A2. The first spring portion 51 is folded or bent to have a U-shaped section and has a plurality of first leaf springs 51 a greater in height and a plurality of second leaf springs 51*b* smaller in height. Each of the second spring portions 52 has a deformed portion 52*a* gently curved.

Figure 4A:
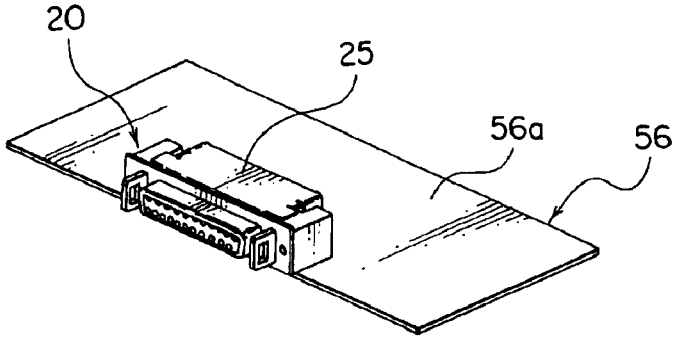
FIG. 4A is a perspective view showing the connector in FIG. 1A in a state where it is mounted on a circuit board.
Figure 4B:
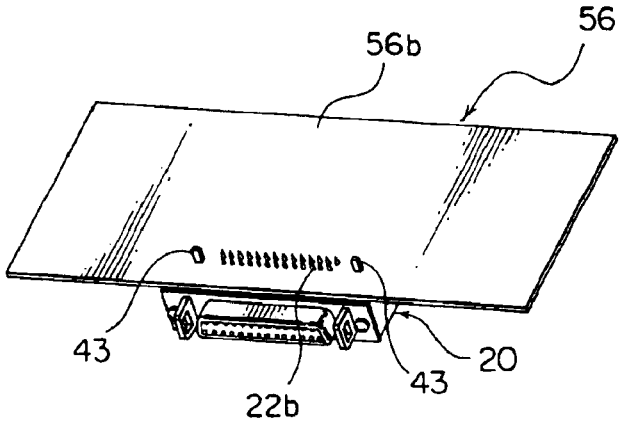
FIG. 4B is a perspective view of the connector in the state illustrated in FIG. 4A but as seen from a rear side of the circuit board.
Figure 4C:
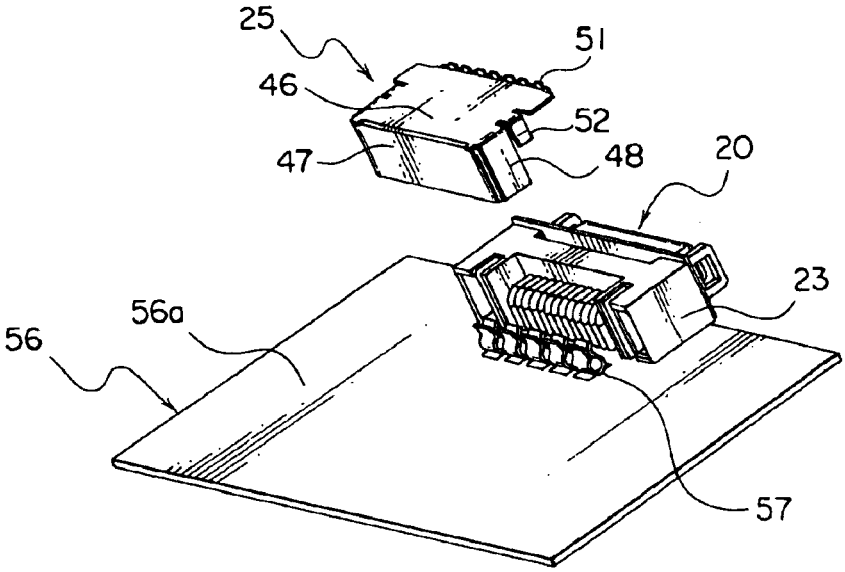
FIG. 4C is a perspective view of the connector in the state illustrated in FIG. 4A but before the shielding cover is attached.

Referring to FIGS. 4A to 4C in addition, description will be made of a mode of use of the above-mentioned receptacle connector 20.

The receptacle connector 20 is mounted on an upper surface 56*a* of a circuit board 56 mounted on an electronic apparatus (not shown). When the receptacle connector 20 is mounted on the circuit board 56, each of the terminal portions 22*b* of the contacts passes through a through hole formed in the circuit board 56, protrudes on a lower surface 56*b* of the circuit board 56, and is electrically connected to an electric circuit formed on the circuit board 56. Simultaneously, each of the leg portions 43 of the mounting members 41 is press-fitted into a fitting hole formed in the circuit board 56 and mechanically fixed.

On the upper surface 56*a* of the circuit board 56, a plurality of conductive ground contacts 57 are disposed at a position corresponding to a rear surface of the receptacle connector 20. Each of the ground contacts 57 used herein is of a socket type and is connected to a ground pattern formed on the circuit board 56. As will later become clear, the shielding cover 25 is removably attached to the insulator 23. When the shielding cover 25 is attached to the insulator 23, the rear plate portion 47 of the shielding cover 25 is inserted into and contacted with the ground contacts 57 to achieve ground connection.

Further referring to FIGS. 5A to 5E, the description proceeds.

Figure 5D:
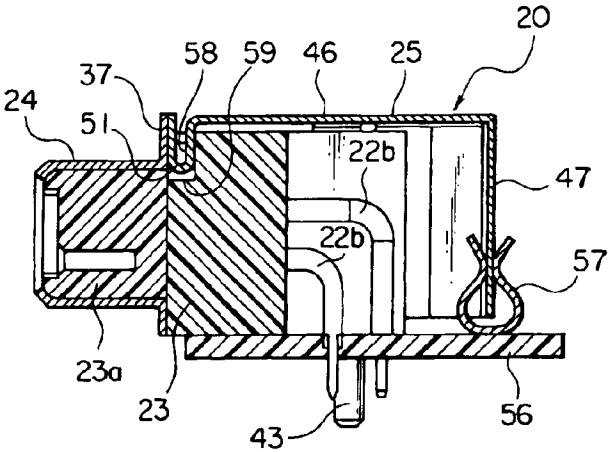
FIG. 5D is a sectional view taken along a line Vd—Vd in FIG. 5A.

As clearly shown in FIG. 5D, the insulator 23 has an engaging portion 58 adjacent to the flange 37 of the shell plate 24 in the first direction A1. Specifically, the flange 37 and the engaging portion 58 are faced to and spaced from each other to define a recessed portion 59 therebetween. The first spring portion 51 is press-fitted into the recessed portion 59. Therefore, the first spring portion 51 is directly engaged with the insulator 23 in the first direction A1 and the first and the second leaf springs 51*a* and 51*b* are press-contacted with the flange 37 of the shell plate 24. As a consequence, the shielding cover 25 is engaged with the insulator 23 in the first direction A1 and electrically connected to the shell plate 24. The shell plate 24 surrounds a protruding portion 23*a* of the insulator 23.

Figure 5E:
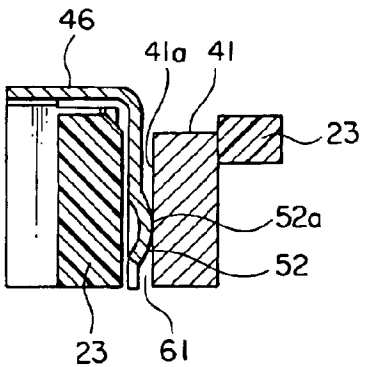
FIG. 5E is a sectional view taken along a line Ve—Ve in FIG. 5A and showing a characteristic part alone.
Figure 5C:
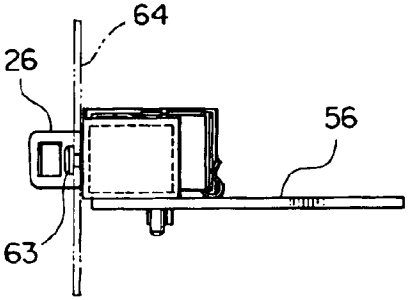
FIG. 5C is a right side view of the connector in the state illustrated in FIG. 4A.
Figure 5A:
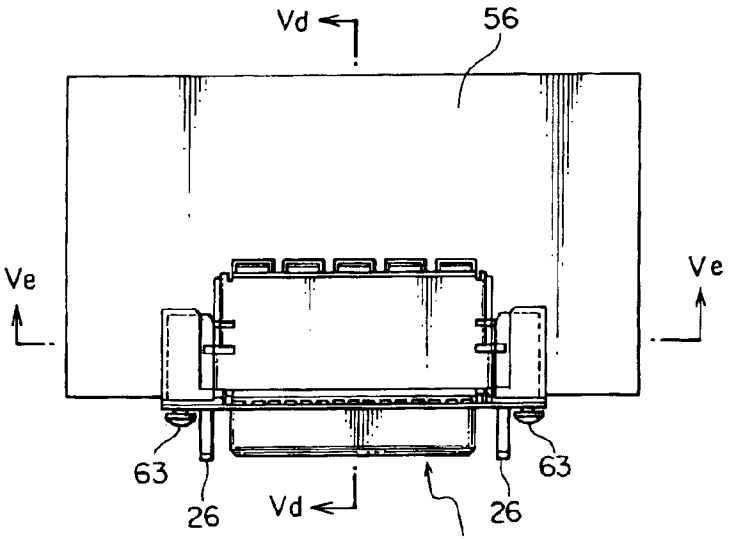
FIG. 5A is a plan view of the connector in the state illustrated in FIG. 4A.
Figure 5B:
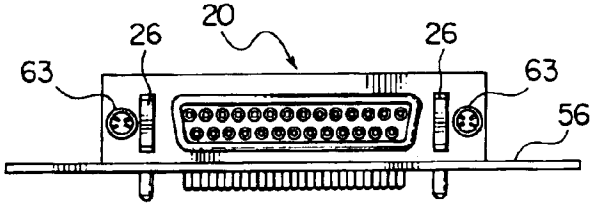
FIG. 5B is a front view of the connector in the state illustrated in FIG. 4A.

As clearly shown in FIG. 5E, each of the mounting members 41 has a specific surface 41 a faced to the insulator 23 in the second direction A2 with a gap 61 left therefrom. The second spring portion 52 is inserted into the gap 61 and the deformed portion 52*a* is press-contacted with the specific surface 41*a*. Thus, the second spring portion 52 is indirectly engaged with the insulator 23 in the second direction A2.

As described above, in the state where the first spring portion 51 is press-fitted into the recessed portion 59 and the second spring portions 52 are press-contacted with the specific surfaces 41*a*, respectively, the shielding cover 25 is attached to the insulator 23. Thus, the shielding cover 25 is removably attached to the insulator 23.

When the shielding cover 25 is attached to the insulator 23, the shielding cover 25 and the insulator 23 define a space 62 in cooperation. The terminal portions 22*b* of the contacts 22 protrude from the insulator 23 into the space 62. The shell plate 24 is fixed by a plurality of screw members 63.

Figure 6A:
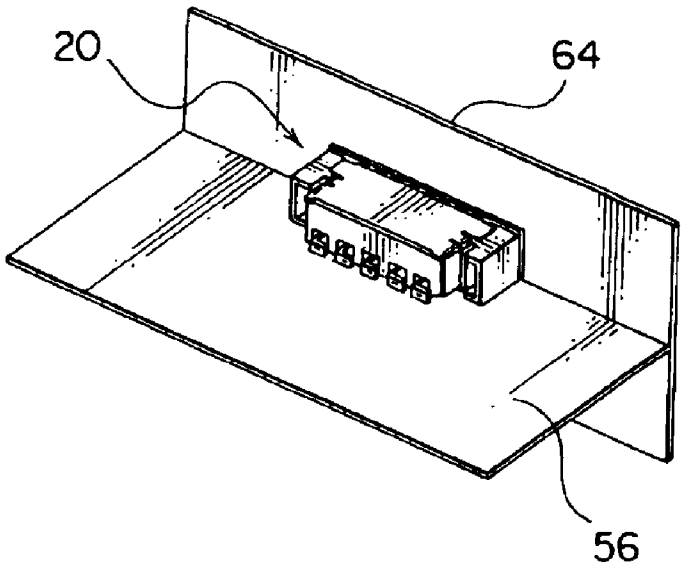
FIG. 6A is a perspective view of the connector in the state illustrated in FIG. 4A as seen from a rear side, together with a front plate of an electronic apparatus.
Figure 6B:
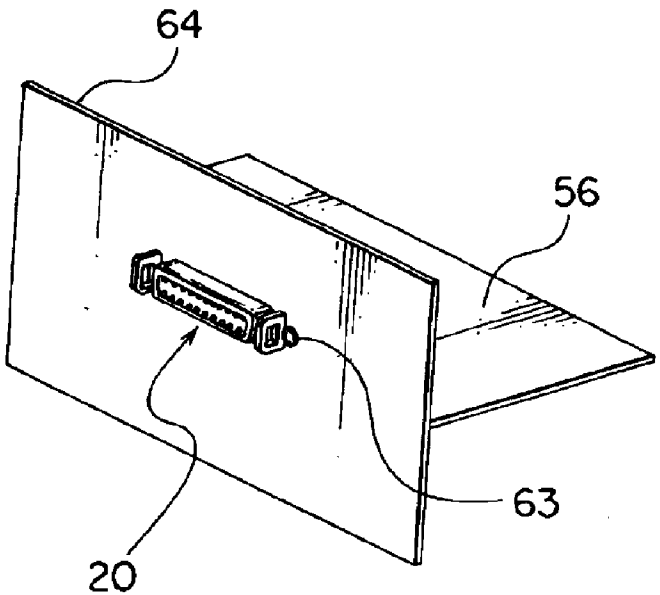
FIG. 6B is a perspective view corresponding to FIG. 6A as seen from a front side.

FIGS. 6A and 6B show the relationship between the receptacle connector 20 mounted on the circuit board 56 and a housing panel or a front plate 64 of the electronic apparatus. The screw members 63 for fixing the shell plate 24 are also used for connection with the front plate 64.

Figure 7:
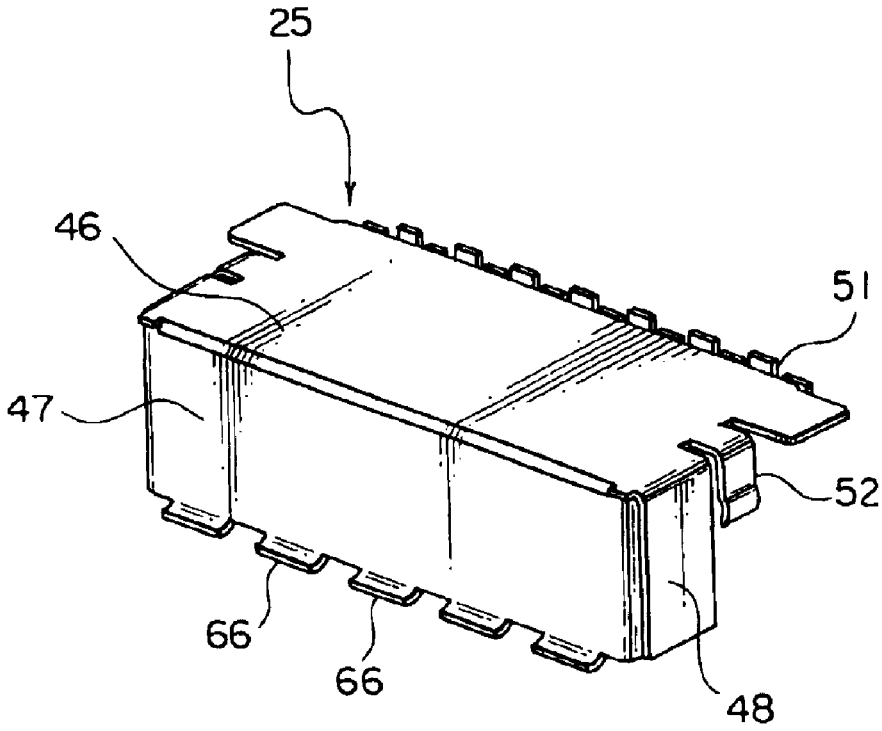
FIG. 7 is a perspective view showing a modification of the shielding cover.

Referring to FIG. 7, description will be made of a modification of the shielding cover 25. Similar parts are designated by like reference numerals and description thereof will be omitted.

The shielding cover 25 illustrated in FIG. 7 has a plurality of ground terminal portions 66 formed at a lower end of the rear plate portion 47. Each of the ground terminal portions 66 is folded or bent rearward from the lower end of the rear plate portion 47.

Figure 8A:
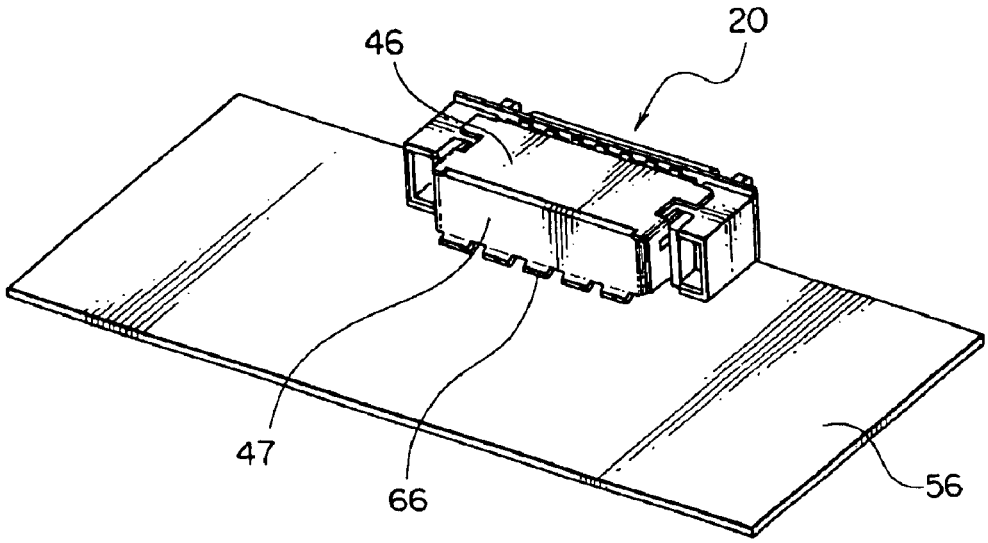
FIG. 8A is a perspective view of a connector comprising the shielding cover in FIG. 7 in a state where it is mounted on a circuit board.
Figure 8B:
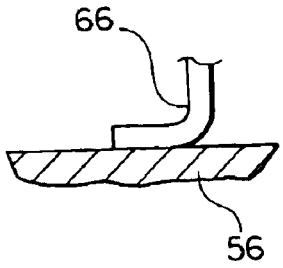
FIG. 8B is a sectional view of a characteristic part of FIG. 8A.
Figure 9:
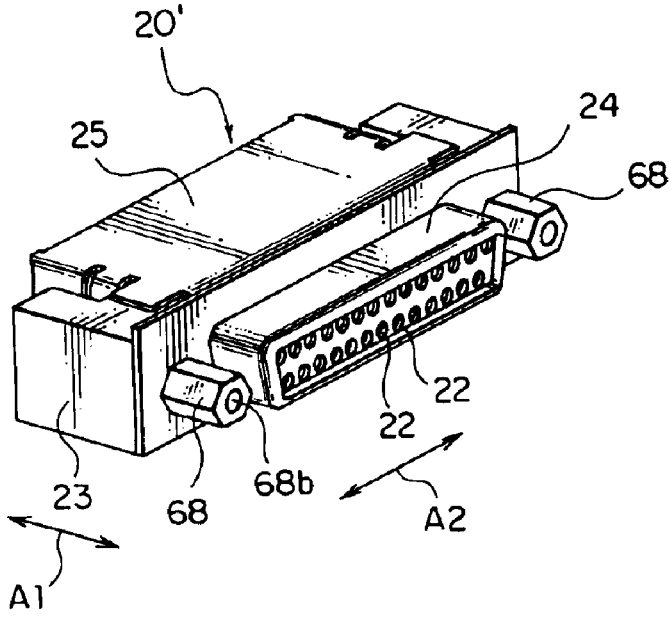
FIG. 9 is a perspective view of a connector according to a second embodiment of the present invention.
Figure 10:
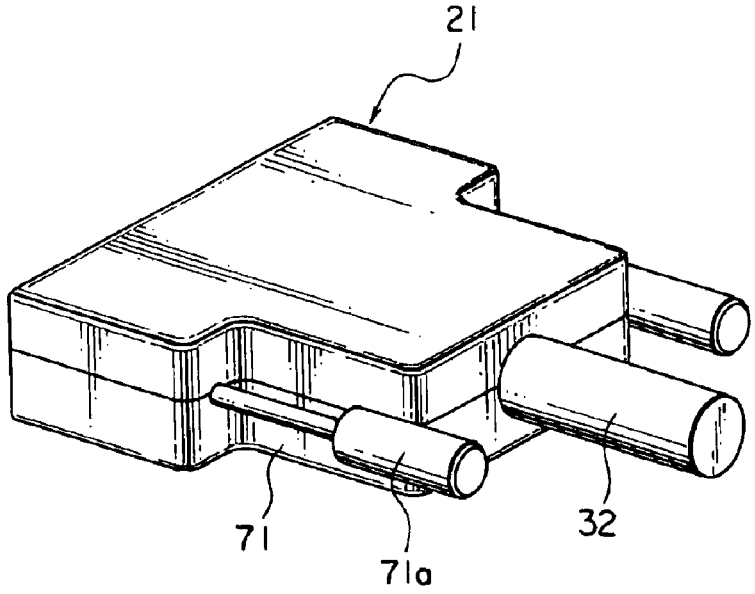
FIG. 10 is a perspective view of another connector as a mating object to be connected to the connector in FIG. 9.
Figure 11:
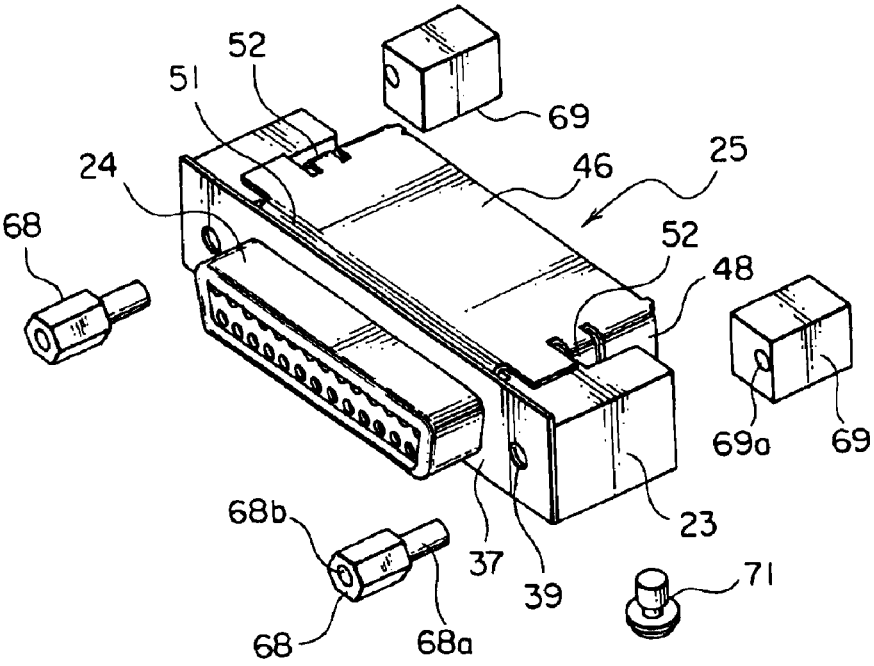
FIG. 11 is an exploded perspective view of the connector illustrated in FIG. 9.

As illustrated in FIGS. 8A and 8B, the ground terminal portions 66 are brought into contact with the upper surface 56*a* of the circuit board 56 to achieve ground connection.

Referring to FIGS. 9 through 12, description will be made of a connector 20' according to a second embodiment of the present invention together with another connector 21' as a mating object to be connected to the connector 20'. Herein, the connector 20' corresponds to the receptacle connector 20 in FIG. 1A while the connector 21' corresponds to the plug connector in FIG. 1B. Similar parts are designated by like reference numerals and description thereof will be omitted.

Figure 12:
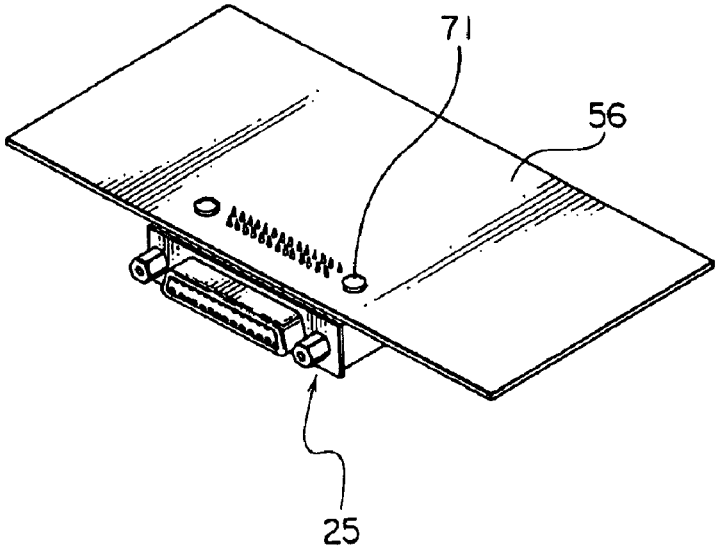
FIG. 12 is a perspective view of the connector in FIG. 9 in a state where it is mounted on a circuit board.

The receptacle connector 20' has a pair of hexagonal nuts 68 as fixed locking members for achieving mechanical engagement with the plug connector 21' in the first direction A1, and a pair of screw blocks 69 as mounting members incorporated into the insulator 23. Each of the hexagonal nuts 68 has a male screw portion 68*a* screwed into a screw hole 69*a* of the screw block 69 through the through hole 39. As a consequence, the hexagonal nuts 68, the screw blocks 69, and the shell plate 24 are securely fixed to the insulator 23. The receptacle connector 20' is attached to the circuit board 56 as illustrated in FIG. 12 by screwing a pair of screw members 71 into screw holes (not shown) formed on lower surfaces of the screw blocks 69, respectively.

The plug connector 21' has a pair of screw rods 71 corresponding to the hexagonal nuts 68, respectively. Each screw rod 71 has a tab 71*a*.

The receptacle connector 20' and the plug connector 21' are fitted to each other and electrically connected to each other. Thereafter, the tab 71*a* of each screw rod 71 is rotated. Then, a front end of each screw rod 71 is screwed into a screw hole 68*b* of each hexagonal nut 68. As a consequence, the receptacle connector 20' and the plug connector 21' are locked in a connected state.

While this invention has thus far been described in conjunction with the preferred embodiments thereof, it will be readily possible for those skilled in the art to put this invention into practice in various other manners without departing from the scope set forth in the appended claims.

What is claimed is:

1. A connector to be mounted on a circuit board, said connector comprising:

a conductive contact having a contacting portion and a terminal portion; an insulator holding said contact;

a conductive shell sounding said contacting portion of the contact; and a conductive shielding cover held by said insulator and surrounding said terminal portion of the contact;

said shielding cover being electrically connected to said shell and said circuit board;

wherein said shielding cover comprises:

a first spring portion engaged with said insulator in a first direction: and a second spring portion engaged with said insulator in a second direction perpendicular to said first direction:

wherein said insulator has an engaging portion adjacent to said shell in said first direction; said first spring portion being engaged with said engaging portion; and wherein said shell has a flange facing said engaging portion in said first direction and defining a recessed portion between said flange and said engaging portion, said first spring portion being inserted into said recessed portion and contacting said flange.

2. The connector according to claim 1, wherein said first spring portion is folded or bent to have a U-shaped section, said first spring portion being press-fitted into said recessed portion to be press-contacted with said engaging portion and said flange.

3. The connector according to claim 1, wherein said circuit board has a ground contact, said shielding cover being electrically connected to said ground contact.

4. The connector according to claim 1, wherein said shielding cover has a ground terminal portion to be brought into contact with said circuit board.

5. The connector according to claim 1, wherein said shielding cover has a plate portion defining a space in cooperation with said insulator, said terminal portion of the contact protruding from said insulator into said space.

6. A connector to be mounted on a circuit board, said connector comprising:

a conductive contact having a contacting portion and a terminal portion; an insulator holding said contact;

a conductive shell sounding said contacting portion of the contact;

a conductive shielding cover held by said insulator and surrounding said terminal portion of the contact;

said shielding cover being electrically connected to said shell and said circuit board;

wherein said shielding cover comprises:

a first spring portion engaged with said insulator in a first direction; and a second spring portion engaged with said insulator in a second direction perpendicular to said first direction; and wherein said insulator has an engaging portion adjacent to said shell in said first direction, said first spring portion being engaged with said engaging portion; and a mounting member coupled to said insulator to fix said insulator to said circuit board, said mounting member having a specific surface facing said insulator in said second direction with a gap therebetween, said second spring portion being press-fitted into said gap.

7. The connector according to claim 6, further comprising a locking portion coupled to said mounting member and adapted to achieve mechanical engagement with a mating object in said first direction.

8. The connector according to claim 6, wherein said circuit board has a ground contact, said shielding cover being electrically connected to said ground contact.

9. The connector according to claim 6, wherein said shielding cover has a ground terminal portion to be brought into contact with said circuit board.

10. The connector according to claim 6, wherein said shielding cover has a plate portion defining a space in cooperation with said insulator, said terminal portion of the contact protruding from said insulator into said space.

* * * * *